US006454591B1

(12) United States Patent
Pradier et al.

(10) Patent No.: US 6,454,591 B1
(45) Date of Patent: Sep. 24, 2002

(54) ELECTRICAL CONNECTION DEVICE AND POWER DISTRIBUTION APPARATUS COMPRISING IT

(75) Inventors: Jean-Clair Pradier, Houilles (FR); Philippe Perez, Sevres (FR)

(73) Assignee: Labinal, Montigny-le-Bretonneux (FR)

( * ) Notice: Subject to any disclaimer, the term of this patent is extended or adjusted under 35 U.S.C. 154(b) by 0 days.

(21) Appl. No.: 09/821,748

(22) Filed: Mar. 30, 2001

(30) Foreign Application Priority Data

Mar. 31, 2000 (FR) ..... 00 4153

(51) Int. Cl.[7] ..... H01R 13/627
(52) U.S. Cl. ..... 439/364; 439/926
(58) Field of Search ..... 439/362, 364, 439/365, 801, 805, 926

(56) References Cited

U.S. PATENT DOCUMENTS 3,812,381 A * 5/1974 Guyton ..... 361/774
6,053,758 A * 4/2000 Kato et al. ..... 439/364
6,293,830 B1 * 9/2001 Park et al. ..... 439/709

FOREIGN PATENT DOCUMENTS

DE 41 21 011 A1 1/1992
DE 41 21 331 A1 1/1993

* cited by examiner

*Primary Examiner*—Neil Abrams
*Assistant Examiner*—Phuong Dinh
(74) *Attorney, Agent, or Firm*—Larson & Taylor PLC

(57) ABSTRACT

An electrical connecting device connects a conductor to a conductive strip carried by an insulating panel. The connecting device includes a base member having a mechanical attachment to a support, and a connector for electrically connecting the conductor to the base member. A conductive member is carried by the panel and is connected to the conductive strip. The conductive member projects along a rear face of the panel and has a surface for coupling to the base member. A mechanism mechanically attaches the conductive member in contact with the base member. The mechanism passes through the conductive member and includes a control region which is accessible from the front face of the plate.

17 Claims, 2 Drawing Sheets

ELECTRICAL CONNECTION DEVICE AND POWER DISTRIBUTION APPARATUS COMPRISING IT

The present invention relates to an electrical connection device for connecting a conductor to a conductive track provided on an insulating panel.

In an electrical power distribution network, particularly one installed in an aircraft, it is known to provide power distribution devices comprising a set of power contactors distributed over an insulating panel having conductive strips. Each contactor comprises switching means.

A power distribution apparatus of this kind is supplied by one or more primary distribution networks from generators, e.g. ones which are integrated in the reactors of the aircraft.

The power distribution apparatus is adapted to distribute the power to one or more secondary power distribution networks supplying the functional components of the aircraft.

The insulating panel of the power distributor comprises a set of conductive strips formed by metal bars having a cross sectional area of approximately 100 to 150 $mm^2$.

These conductive bars, constituting the primary network of the aircraft, are connected to flexible conductors connected to one of the secondary networks of the aircraft. These flexible conductors are generally formed by cables of circular cross section or braided conductors. The connection between the conductive strips and the flexible conductors is ensured by bolting terminal-connectors installed at the ends of the flexible conductors onto the conductive strips.

When work has to be done on the power distribution apparatus, the task of dismantling and re-establishing the connections between the flexible conductors and the conductive strips is a time-consuming and labourious business which is also made difficult by the large number of conductors present around the power distribution apparatus. Moreover, the need for access to these connections results in a bulky construction which increases the weight and cost of the electricity distribution system.

The aim of the invention is to provide an electric connection device by means of which a conductive strip can easily be connected to an electric conductor.

For this purpose, the invention relates to an electrical connecting device for connecting a conductor to a conductive strip carried by an insulating panel, characterised in that it comprises:

- a base member comprising, on the one hand, mechanical means of attachment to a support and, on the other hand, means for electrically connecting the conductor to the base member;
- a conductive member carried by the panel and electrically connected to the conductive strip, said conductive member projecting relative to the panel along a rear face of the plate and having a coupling surface adapted to come into contact with a complementary coupling surface formed on the base member; and
- means for mechanically attaching the conductive member in contact with the base member, said means passing through the conductive member and comprising a control region which is accessible from the front face of the panel.

According to particular embodiments, the electrical connecting device has one or more of the following features:

- the mechanical connecting means comprise means for clamping the conductive member against at least part of the base member in a docking direction;
- the base member comprises a part which is freely movable relative to said support, along a specified path, in at least one direction of the plane extending perpendicularly to said docking direction, and said coupling surface of the base member is formed on said movable part;
- one of said conductive member and said base member comprises means for aligning the other one of said conductive member and said base member, along an axis parallel to the docking direction;
- said alignment means comprise a cavity delimited by a frustum-shaped surface converging towards the base of said cavity;
- the base member comprises a part which is freely movable relative to said support, along a specified path, in said docking direction, and said coupling surface of the base member is formed on said movable part;
- said clamping means comprise a screw the head of which exerts a force on said conductive member and the threaded end of which co-operates with a corresponding threaded section of the base member;
- it comprises a nut mounted to be slidably movable relative to a part of the base member on which said coupling surface is formed, and the part of the base member on which said coupling surface is formed comprises a stop abutment for said nut counter to the traction of the screw; and
- said conductive member is integral with a strip provided on the front face of the panel.

The invention further relates to a power distribution apparatus comprising a protective cabinet and an insulating panel provided with conductive strips, the panel being accommodated inside said cabinet, characterised in that it comprises at least two connecting devices as hereinbefore defined, the base members of the connecting devices being fixed to the inner surface of the same wall of said cabinet, and in that the insulating panel is mounted in said cabinet opposite said surface carrying the base members with the conductive members of the connecting devices carried by the panel aligned with said base members.

Advantageously, the device comprises additional means for holding the panel along the wall, said additional holding means being independent of the electrical connecting devices.

The invention will be more easily understood by studying the following description, which is provided solely by way of example and with reference to the drawings, wherein.

Figure 1:
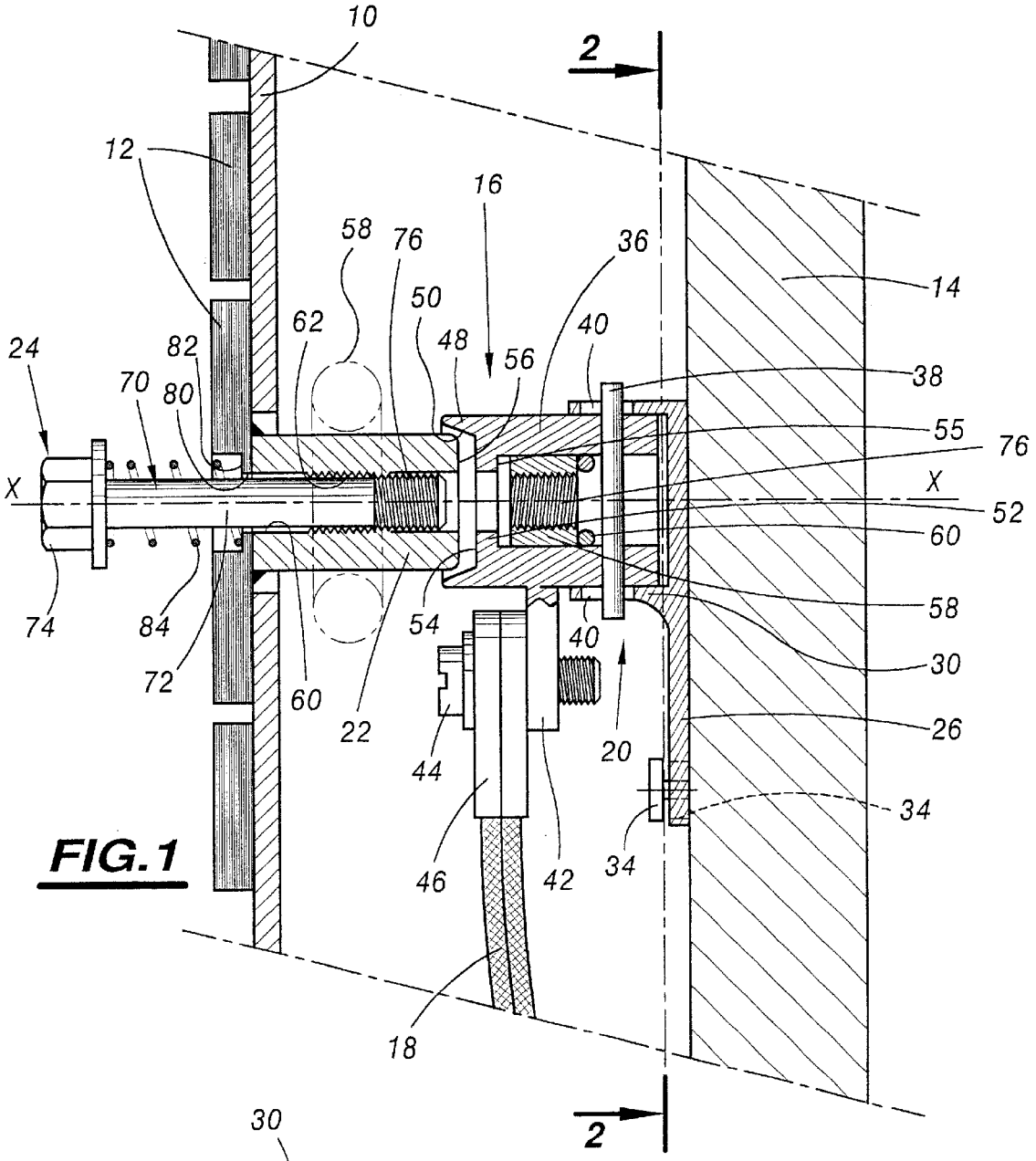
FIG. 1 is a sectional view of an electric connecting device shown in the disconnected position, this device being disposed between an insulating panel carrying conductive strips and the wall of a cabinet.

FIG. 1 shows, in partial view, an insulating panel 10 of a power distribution apparatus. This insulating panel has conductive strips 12 formed by metal bars attached to a front face of the insulating panel 10.

Figure 3:
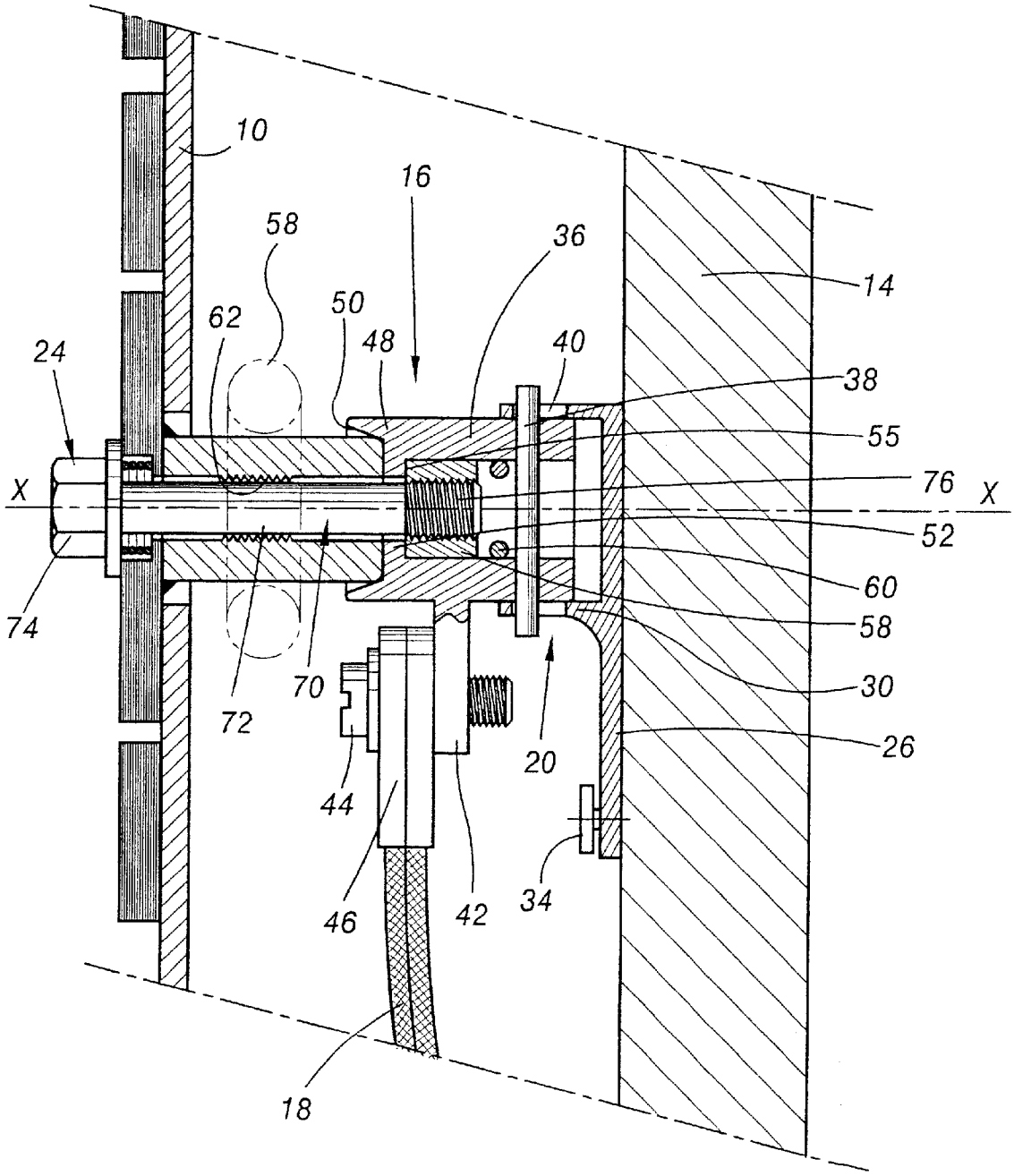
FIG. 3 is a view analogous to that of FIG. 1, with the electrical connecting device shown in the connected position.

The panel 10 carrying the conductive strips 12 is accommodated in a cabinet, of which only a back wall 14 is shown in FIGS. 1 and 3. The panel 10 and back wall 14 extend parallel to each other.

An electrical connecting device 16 according to the invention is located between the panel 10 and the rear wall 14. This device provides an electrical connection between a conductive strip 12 of the panel and a braided electricity conductor 18.

In practice, a plurality of devices 16 are provided for the same plate 10 to ensure that a plurality of separate strips are connected to a plurality of independent conductors.

The panel 10 is mechanically held in place along the wall 14 by holding means which are independent of the devices 16. These holding means may be screws, for example.

The electrical connecting devices 16 essentially comprise a base member 20 carried by the wall 14, a conducting member 22 carried by the panel 10 and fixedly attached to a strip 12 which is to be connected, as well as means 24 for mechanically connecting the conducting member 22 in contact with the base member 20. The conducting member 22 and the base member 20 are brought into engagement in a docking direction X-X perpendicular to the wall 14.

Figure 2:
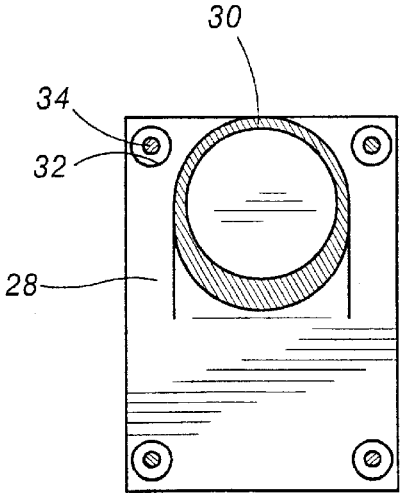
FIG. 2 is a sectional view of the base member of the electrical connecting device in FIG. 1, taken along the line 2—2.

More precisely, the base member 20 comprises a plinth 26 which is also shown in FIG. 2. This plinth 26 comprises a substantially flat rectangular base 28 adapted to be applied against the surface of the wall 14. This base 28 carries a shaft 30 of circular cross section the axis of which is arranged perpendicularly to the surface of the base 28. The base 28 and the shaft 30 are integrally formed with each other.

Four openings of circular cross section 32 are provided in the angles of the base 28. These openings 32 are provided for the shanks of the retaining screws 34 to pass through. The diameter of each opening 32 is much greater than the outer diameter of the screw shanks, so as to allow the functional play in every direction of the plane perpendicular to the docking direction X—X to be taken up. However, the diameter of the openings 32 is less than the diameter of the heads of the screws 34.

The openings 32 and the screws 34 ensure that the plinth 26 and wall 14 are firmly fixed together while allowing the plinth 26 to move freely relative to the wall 14 in every direction of the plane of the wall 14.

The base 20 further comprises a sleeve 36 mounted to be axially movable relative to the plinth 26 in the docking direction X—X. The sleeve 36 has a generally cylindrical outer shape and a diameter corresponding to the internal diameter of the shaft 30. One end of the sleeve is slidably accommodated within this shaft. Thus, the axis of the sleeve extends in the docking direction X—X.

A split pin 38 passes right through said sleeve, extending diametrically. The ends of the pin 38 project into eyelets 40 provided in the side wall of the shaft 30. The length of the eyelets extends along the generatrices of this shaft. The eyelets co-operate with the ends of the split pin 38 to limit the axial movement of the sleeve 36 along the axis X—X.

Laterally, the sleeve 36 has a connecting lug 42 for the braid 18. This lug has a screw-threaded passage which accommodates a screw 44 for mechanically retaining and electrically connecting a terminal-connector 46 crimped to the end of the braid 18.

At its opposite end to the one accommodated in the shaft 30, the sleeve 36 has a flange 48 the inner lateral surface 50 of which is frustum-shaped. Thus, the sleeve has, at its end, a recess the internal section of which decreases progressively from its free end to the inside of the sleeve. This frustum-shaped surface 50 forms a means of aligning the conductive member 22 and the base member 20 in the docking direction X—X.

The frustum-shaped surface 50 terminates in a small inner flange 52 defining a shoulder 54 forming an annular surface for electrical coupling between the base member 20 and the conductive member 22.

Along its other side the small flange 52 defines a shoulder 55 forming an axial abutment for a nut 58 which is secured against rotation inside the sleeve 36. This nut is free to move axially along a path defined between the shoulder 56 and two split pins 60 engaging inside the sleeve and extending along chords thereof. The nut 58 is thus trapped inside the sleeve.

The conductive member 22 is formed by a small column the length of which is adapted to pass through the insulating panel 10. One end of the column 22 is welded to the conductive strip 12 which extends over the front face of the panel. The other end of the column projects beyond the rear surface of the insulating panel 10. The free end of the column 22 defines an annular coupling surface 56 complementary to the coupling surface 54 provided on the base member 20.

The column 22 extends perpendicularly to the panel, its axis being oriented in the docking direction X—X.

Around the column 22 is placed a winding 58 forming a current pickup for analysing the current passing through the connecting device.

The column 22 has a passage 60 passing axially through it, which has a screw-threaded section 62 in its median part located between two smooth sections.

The means 24 for mechanically connecting the column 22 and the base member 20 comprise a screw 70 having a shank 72 and a head 74 provided with a drive profile. The shank 72 is provided with a screw thread 76 only at its end section, the major part of the shank being smooth. The thread on the end of the screw is adapted to co-operate with the threading of the nut 58 and the threading of the section 62 of the column.

As shown in FIGS. 1 and 3, the shank 72 engages through the column 22 in the passage 60. The conductive strip 12 has a passage 80 for the screw shank. This passage is bordered by an abutment surface for the head 74 of the screw.

According to the embodiment shown, the passage 80 has a counterbore 82 opening out on the screw head 74 side. In this counterbore is arranged a helical spring 84 bearing on the bottom of the counterbore and on the screw head 74. This spring 84 is adapted to push the screw head 74 away from the strip 12. The counterbore 82 and the spring 84 are optional.

The connecting device shown in the drawings operates as follows.

As shown in FIG. 1, when the two parts of the electrical connecting device 16 are uncoupled, the screw 70 is retained in the passage 60 of the column by the presence of the tapped section 62 which prevents the screw 70 from coming out unless it is unscrewed. Thus, the screw 70 cannot be lost.

Under the effect of the helical spring 84, the screw head 74 is held away from the strip 12, thus ensuring the total retraction of the threaded section of the screw inside the passage 60.

When the panel is initially put into position, or when it is re-installed, each of the columns is brought into position substantially opposite the associated base member carried by the wall 14. The free end of the column is then engaged in the recess formed at the entry to the corresponding sleeve 36 in the direction of docking X—X. When the column and the base member are brought together, the base member is made to move in the plane of the wall 14 under the effect of the end of the column co-operating with the frustum-shaped surface 50, thus ensuring alignment of the sleeve 36 and the column 22. The movement of the base member relative to the wall 14 is made possible by means for fixing the base member to the wall which allow this degree of freedom.

When the complementary coupling surfaces 54 and 56 are brought into contact with each other, the screw 70 engages in the nut 58. The screw is then tightened until, as shown in FIG. 3, the nut bears on the flange 52 of the sleeve. In this position, the complementary coupling surfaces 54 and 56 are clamped against each other in the docking direction defined by the axis X—X.

In the configuration shown in FIG. 3, it will be seen that the column 22 and the sleeve 36 form a passage for electric current between the strip 12 and the braid 18.

The connecting device described here is particularly convenient. In fact, it allows connection between the strips 12 carried by the insulating panel and the conductors 18, simply by positioning the insulating panel along the wall 14 to which the base members 20 are permanently fixed, and by tightening the screws 70.

Moreover, the main elements of the connecting device 16 are arranged behind the insulating panel, thus freeing the surface on the front face of the panel. Only the screw head 74, constituting a means of controlling the mechanical connecting means formed by this screw, is accessible from the front face of the insulating panel. Thus, the majority of the front face of the panel can be used for installing functional components which will be useful for the power distribution apparatus.

Because of the centring means 50 provided between the column 22 and the base member 20, the alignment between the column and the base member is made easier. Moreover, as the coupling surface 54 carried by the base member is free to move in the plane of the wall 14 and in the docking direction X—X, the manufacturing tolerances of the insulating panel and the conductive strips 12 may increase the mobility of the surface 54, ensuring that the complementary coupling surfaces are perfectly in contact with one another after the tightening of the screw 70.

Alternatively, the spring 84 may be replaced by a corrugated washer for slowing down the screw and retaining it with its threaded section inside the passage 60.

What is claimed is:

1. Electrical connecting device for connecting a conductor located adjacent a base to a conductive strip carried by an insulating panel, comprising:

a base member including a base attachment means for mechanical attachment of said base member to the base, and a connector means for electrically connecting the conductor to the base member, and a movable part which is freely movable relative to the base along a specified path in at least one direction of a plane, said part having a base coupling surface;

a conductive member carried by the panel and electrically connected to the conductive strip, said conductive member projecting from a rear face of the panel and having a conductive coupling surface adapted to come into complementary contact with the base coupling surface formed on the base member; and a conductive attachment means for mechanically attaching the conductive member in contact with the base member, said conductive attachment means passing through the conductive member and including a clamping means for clamping the conductive member against said movable part of the base member in a docking direction which is perpendicular to the plane, and a control region which is accessible from a front face of the panel.

2. Device according to claim 1, wherein one of said conductive member or said base member comprises an alignment means for aligning the other one of said conductive member and said base member along an axis parallel to the docking direction.

3. Device according to claim 2, wherein said alignment means comprises a cavity delimited by a frustum-shaped surface converging towards a base of said cavity.

4. Device according to claim 1, wherein the movable part is also freely movable relative to said base along a second specified path in the docking direction.

5. Device according to claim 1, wherein said clamping means comprise a screw having a head which exerts a force on said conductive member and a threaded end which co-operates with a corresponding threaded section of the base member.

6. Device according to claim 5:

further comprising a nut mounted to be slidably movable relative to said movable part of the base member, and wherein said movable part of the base member on which said base coupling surface is formed comprises a stop abutment for said nut counter to a traction of the screw.

7. Device according to claim 1, wherein said conductive member is integral with a strip provided on the front face of the panel.

8. Power distribution apparatus comprising;

a protective cabinet;

an insulating panel carrying conductive strips, the panel being accommodated inside said cabinet;

at least two connecting devices for connecting a respective conductor to an associated conductive strip carried by said insulating panel, each said connecting device including a base member having (a) a base attachment means for mechanical attachment of said base member to the cabinet, (b) a connector means for electrically connecting the conductor to the base member, and (c) a base coupling surface, a conductive member carried by the panel and electrically connected to the conductive strip, said conductive member projecting relative to the panel along a rear face of the panel and having a conductive coupling surface adapted to come into complementary contact with said base coupling surface, and a conductive attachment means for mechanically attaching the conductive member in contact with the base member, said conductive attachment means passing through the conductive member and having a control region which is accessible from a front face of the panel;

wherein the base members of the connecting devices are fixed to an inner surface of a wall of said cabinet; and wherein the insulating panel is mounted in said cabinet opposite said inner surface carrying the base members with the conductive members of the connecting devices carried by the panel aligned with said base members.

9. Apparatus according to claim 8, further comprising additional means for holding the panel along the wall, said additional holding means being independent of the electrical connecting devices.

10. Apparatus according to claim 8, wherein the mechanical attaching means each comprise a clamping means for clamping an associated conductive member against an associated base member in a docking direction.

11. Apparatus according to claim 10:

wherein the base members each comprise a movable part which is freely movable relative to said support along a specified path in at least one direction of a plane extending perpendicularly to the docking direction, and wherein each said base coupling surface is formed on an associated said movable part.

12. Apparatus according to claim 11, wherein one of said conductive member or said base member of each said connecting device comprises an alignment means for aligning the other one of said conductive member and said base member along an axis parallel to the docking direction.

13. Apparatus according to claim 12, wherein each said alignment means comprises a cavity delimited by a frustum-shaped surface converging towards a base of said cavity.

14. Apparatus according to claim 10:

wherein each base member includes a movable part which is freely movable relative to said cabinet along a specified path in the docking direction, wherein each said coupling surface of the associated base member is formed on an associated said movable part, and wherein each movable part is also freely movable relative to said cabinet along a second specified path in the docking direction.

15. Apparatus according to claim 10, wherein each said clamping means comprises a screw having a head which exerts a force on an associated said conductive member and a threaded end which co-operates with a corresponding threaded section of an associated base member.

16. Apparatus according to claim 15:

wherein each connecting device further comprises a nut mounted to be slidably movable relative to an associated said movable part of the associated base member on which an associated said base coupling member is formed, and wherein each said movable part of the associated base member on which said base coupling surface is formed comprises a stop abutment for an associated said nut counter to a traction of an associated screw.

17. Apparatus according to claim 8, wherein each said conductive member is integral with an associated strip provided on the front face of the panel.

* * * * *

UNITED STATES PATENT AND TRADEMARK OFFICE

CERTIFICATE OF CORRECTION

PATENT NO. : 6,454,591 B1 
DATED : September 24, 2002
INVENTOR(S) : Pradier et al.

It is certified that error appears in the above-identified patent and that said Letters Patent is hereby corrected as shown below:

Title page,
Item [30], Foreign Application Priority Data, change the data to be:

-- Mar. 31, 2000 (FR) 00 04153 --

Signed and Sealed this

Thirty-first Day of December, 2002

JAMES E. ROGAN
*Director of the United States Patent and Trademark Office*